United States Patent [19]

Dean

[11] 4,445,302

[45] May 1, 1984

[54] BUILDING ROOF STRUCTURE

[76] Inventor: Charles Dean, 2444 McGregor Blvd., Fort Myers, Fla. 33901

[21] Appl. No.: 386,342

[22] Filed: Jun. 8, 1982

[51] Int. Cl.[3] ..... E04B 7/00

[52] U.S. Cl. ..... 52/90; 52/278; 52/543

[58] Field of Search ..... 52/46, 547, 550, 276, 52/278, 90, 94, 543

[56] References Cited

U.S. PATENT DOCUMENTS

| | | | |
|---|---|---|---|
| 604,775 | 5/1898 | Monteer | 52/550 |
| 670,753 | 3/1901 | Abeleven | 52/547 |
| 673,229 | 4/1901 | Windle | 52/547 |
| 1,585,897 | 5/1926 | Davidson | 52/550 |
| 1,961,373 | 6/1934 | Mayhew | 52/46 |
| 2,029,869 | 2/1936 | Hering | 52/550 |

*Primary Examiner*—James L. Ridgill, Jr.

*Attorney, Agent, or Firm*—Shoemaker and Mattare, Ltd.

[57] ABSTRACT

The building roof structure is arranged so that attachment of that structure to building support elements does not require penetration through such roof structure into the interior of the building. The panels overlap and the attachment of the panels to the building support elements occurs in the overlap areas so that elements are interposed between the attachments and the building interior.

20 Claims, 6 Drawing Figures

BUILDING ROOF STRUCTURE

BACKGROUND OF THE INVENTION

The present invention relates, in general, to buildings, and, more particularly, to building roof structures.

Metal building roof systems often use screws to fasten the elements of such roof systems to a purlin deck. Such systems require penetration of the roof cladding. If a screw becomes loosened during the life of the roof, a leak path is formed through which water can flow, thereby penetrating the roof and flowing into the building.

One alternative to requiring penetration is to construct a roof system wherein clips are used to fasten roof cladding to the purlin deck. In such systems, only the end laps have penetration. However, at such end laps, the screws penetrating the cladding produce leak paths.

A further problem with such roof systems involves large span buildings. Thermally induced expansion and contraction in such large span buildings causes movement of the end lap, thereby enlarging any screw holes. Such enlarged screw holes become potential leak paths through which water can penetrate into the building.

Expansion clips located at the end laps have not been successful for a variety of reasons.

SUMMARY OF THE INVENTION

The roof system embodying the present invention does not require penetration into the interior of the building to affix a roof system to a building support system.

The roof system includes a plurality of elongate panels which are coupled together with side adjacent panels via standing seams. The panels are oriented on the roof to be in overlapping relationship with end adjacent panels.

Thus, as viewed from the building ridge toward the building side, some of the panels have that end thereof located farther from the ridge overlapping the end of the next end adjacent panel which end is located nearer to the ridge.

Furthermore, the ends of the panels located nearer the ridge have a closed end structure which prevents water from splashing out of the panel.

The panels are mounted on roof purlins, or the like, via clips and brackets. Screws penetrate the panels to attach the panels to the brackets. However, such penetration is located in the overlapping area so that a panel backstop and a bracket, as well as further insulation, or the like, is interposed between that penetration location and the building interior. The brackets are coupled to the purlins and are flexible to permit thermally induced panel movement to be accommodated through flexure of the brackets.

Thus, there are no penetrations through the roof into the interior of the building. The attachments of the roof to the elements attached to the roof purlins, or the like, occur outside of the building. Leak paths through the roof elements will be located outside the building.

OBJECTS OF THE INVENTION

It is the main object of the present invention to provide a roof structure for a building wherein attachment of such roof to building support elements does not require penetration into the area enclosed by the roof.

Another object of the present invention is to provide a roof structure which accommodates thermally induced roof movement.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
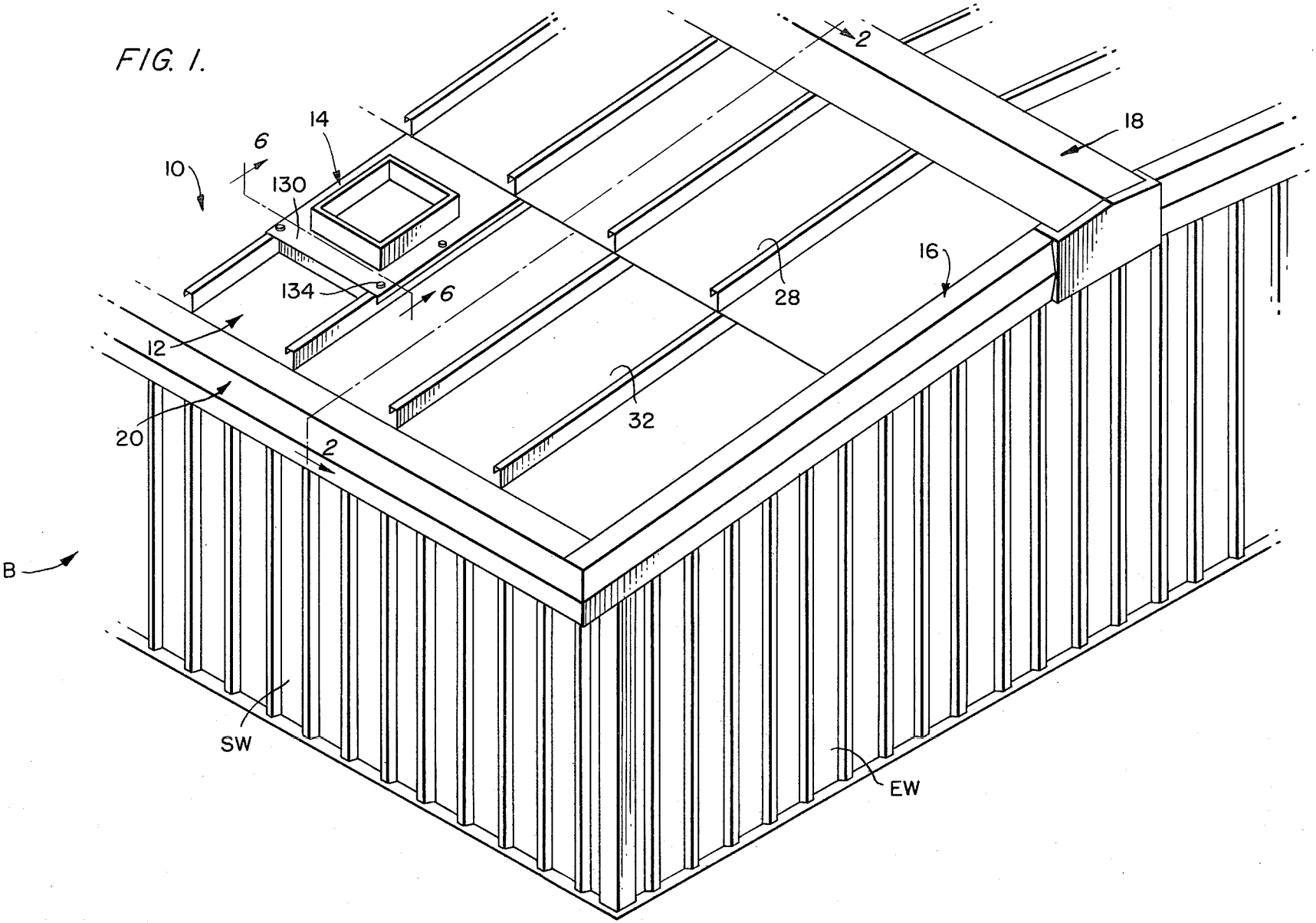
FIG. 1 is a perspective of a building utilizing a roof structure embodying the teachings of the present invention.

Shown in FIG. 1 is a building B having a base with end walls, such as end wall EW, and side walls, such as side wall SW, mounted thereon in any suitable manner. The building includes a roof structure 10 comprised of a multiplicity of elongate panels 12 mounted on building structural elements, such as roof purlins, or the like, to extend transversely of such structural elements. The roof structure shown in FIG. 1 includes a curb 14 for a skylight, vent or roof jack. a rake trim 16, a ridge cap 18 and a gutter system 20.

The roof system of the present invention is formed so that attachment of the roof to the building does not require any penetration into the interior of the building.

Figure 2:
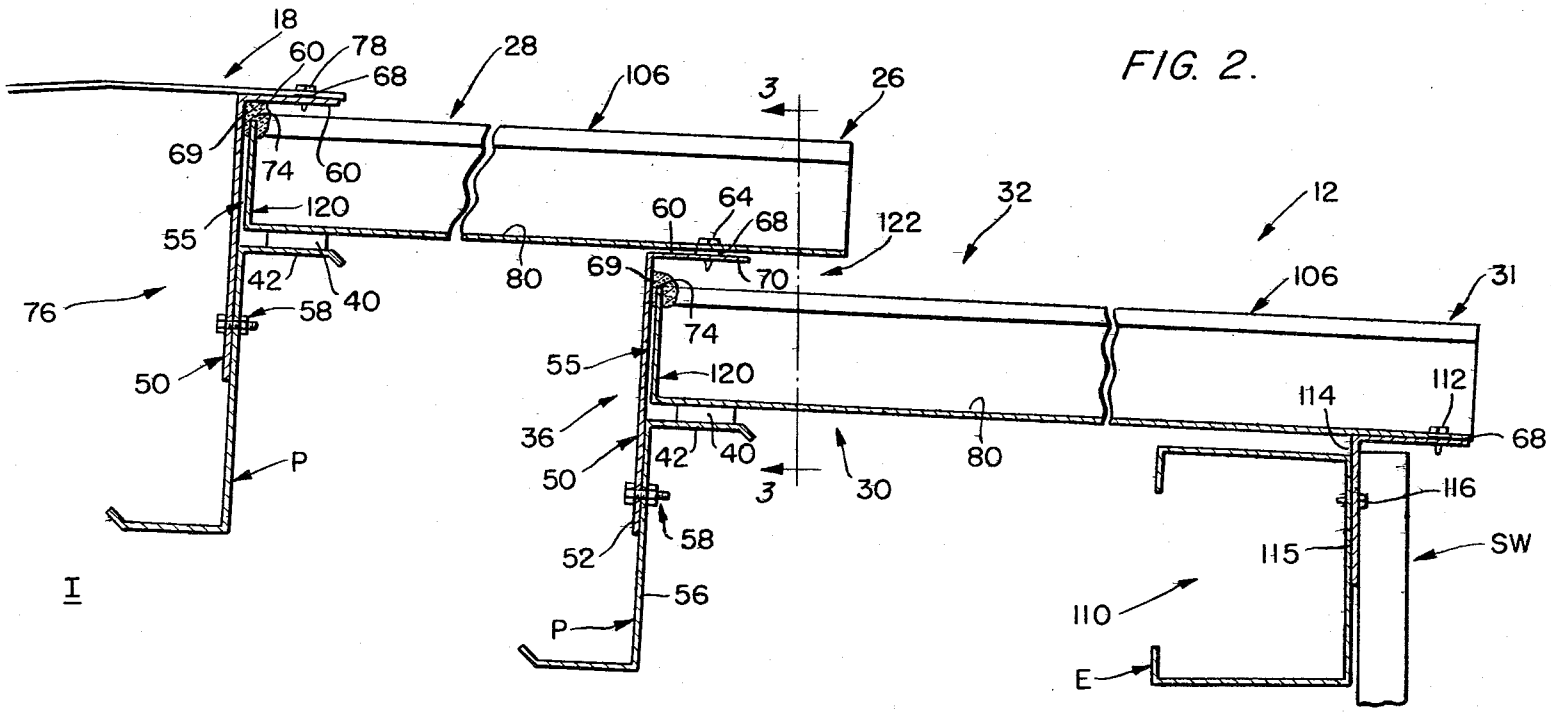
FIG. 2 is a side view in cross-section taken along line 2—2 of FIG. 1.
Figure 3:
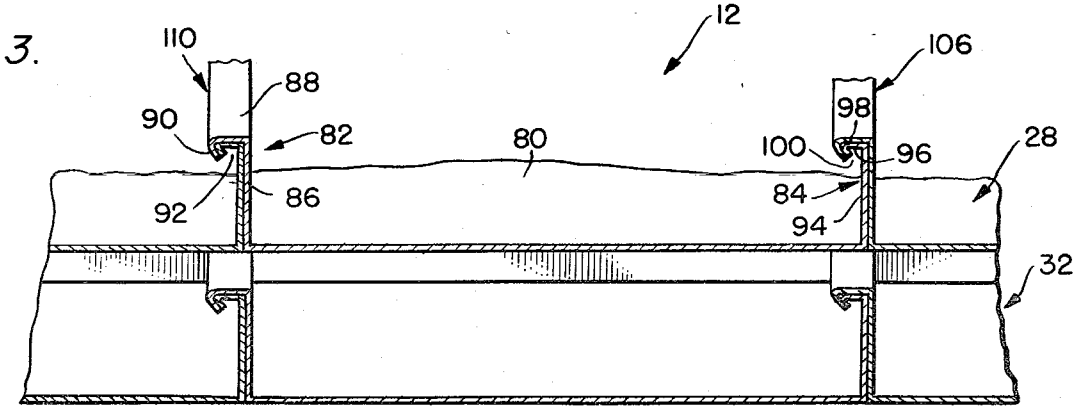
FIG. 3 is an end view of the FIG. 1 roof structure taken along line 3—3 of FIG. 2.

The mounting means of the present invention is best shown in FIGS. 2 and 3, and attention is directed thereto. As shown in FIG. 2, some of the roof panels are imbricated to form a lap at the ends thereof. Thus, lower end 26 of one panel 28 overhangs upper end 30 of an adjacent panel 32 as viewed in the setup configuration of FIG. 1.

Upper end 30 of the panel 32 is mounted on a roof purlin P by a panel attaching means 36. The panel attaching means 36 includes a panel clip 40 mounted on the purlin upper flange 42 and attached to the panel 32. An L-shaped cap angle bracket 50 has the long leg 52 attached to purlin web 56 by fastening means, such as screw 58, or the like, and a short leg 60 attached to lower end 26 of the panel 28 by a fastening means, such as screw assembly 64 or the like, with tape sealer 68 interposed between panel 28 and short leg 60 of bracket 50.

The short leg 60 extends longitudinally of panel 32 from long leg 52 toward the lower end of panel 32. The panel 28 rests on the short leg of the bracket 50, and the screw 64 is located to be spaced down from the long leg 52 of the bracket. Thus, the long leg of the bracket is interposed between the screw 64 and the interior of the building indicated by reference indicator I in FIG. 2. As the screw 64 penetrates the roof panel 28, this penetration is located outside of the building due to the interpositioning of the bracket long leg 52 between building interior I and screw 64. Thus, any leak path defined around the screw 64 merely conducts water through the panel from one location outside of the building to another location outside of the building.

Thermally induced movement of the panels is accommodated by the open space 55 between the bracket 50 and the end of panel 32. However, even if this thermally induced movement enlarges any hole penetrating the roof panels 28 or 32 through which the screw 64, 78 or 112 fits, water flowing through such enlarged hole will not penetrate into the interior of the building.

Flexible closure means 69, such as foam or the like, is interposed between lower surface 70 of the bracket 50 and upper rim 74 of rear wall 120 of the lower panel 32. Thus, the panel 28 is attached to the purlin by the bracket 50 with screw 64 located down from the rear wall 120 of the panel 32 which is attached to the purlin by the clip 40. The clip 40 is attached to the panel in a non-penetrating manner. The location of screw 64 relative to the rear wall 120 of the panel 32 is important and was discussed above.

Panel 28 is attached to a purlin by attaching means 76 which is similar to attaching means 36 and thus will not be further described. A screw 78 attaches ridge cap 18 to the cap angle bracket 50 of the attaching means 76 with tape sealer 68 interposed between the ridge cap 18 and the bracket 50. The screw 78 is located outside of the building with the foam 69 and upper rim 74 of rear wall 120 of the panel 28 as well as the bracket 50 interposed between that screw and the building interior to prevent water penetration into the building as above discussed.

As best shown in FIG. 3, each panel 12 includes a planar mid-portion 80 and side walls 82 and 84 which extend upwardly from that mid-portion. Side wall 82 includes a rib 86 extending upwardly from the mid-portion and a rim 88 extending outwardly from the rib in a plane which is preferably generally parallel to the mid-portion. A seaming lip 90 is positioned on the end of rim 88 and, in the locked configuration, extends downwardly and at an angle with respect to the mid-portion 80. A gap 92 is defined between the side wall 82 and the lip section. Side wall 84 includes a rib 94 extending upwardly from the mid-portion and a rim 96 extending inwardly from the rib in a plane which is preferably co-planar with rim 88. A seaming lip 98 is positioned on the end of rim 96 and, in the locked configuration, extends downwardly and at an angle with respect to the mid-portion 80. A gap 100 is defined between the side wall 84 and the lip section. The rib 86 is slightly taller than the rib 94 and the gap 92 is slightly larger than the gap 100 and receives the rim 96 and lip 98 to form a standing seam 106.

As best shown in FIG. 2, the lower end 31 of roof panel 32 is mounted on an eave strut E by panel attaching means 110. The panel attaching means 110 includes an eave angle bracket 114 with its long leg 115 attached to eave strut E with screw 116 or the like. Roof panel 32 is attached to bracket 114 with screw 112. Tape sealer 68 is interposed between panel 32 and bracket 114. Screw 112 is located outside of the building and bracket 114 is interposed between the screw 112 and the interior of the building.

The upper end of the lower panel 32 has backstop means including a rear wall 120 thereon. The wall helps to occlude gap 122 defined between the panels 28 and 32 and prevents water from penetrating through the roof into the interior of the building.

Figure 4:
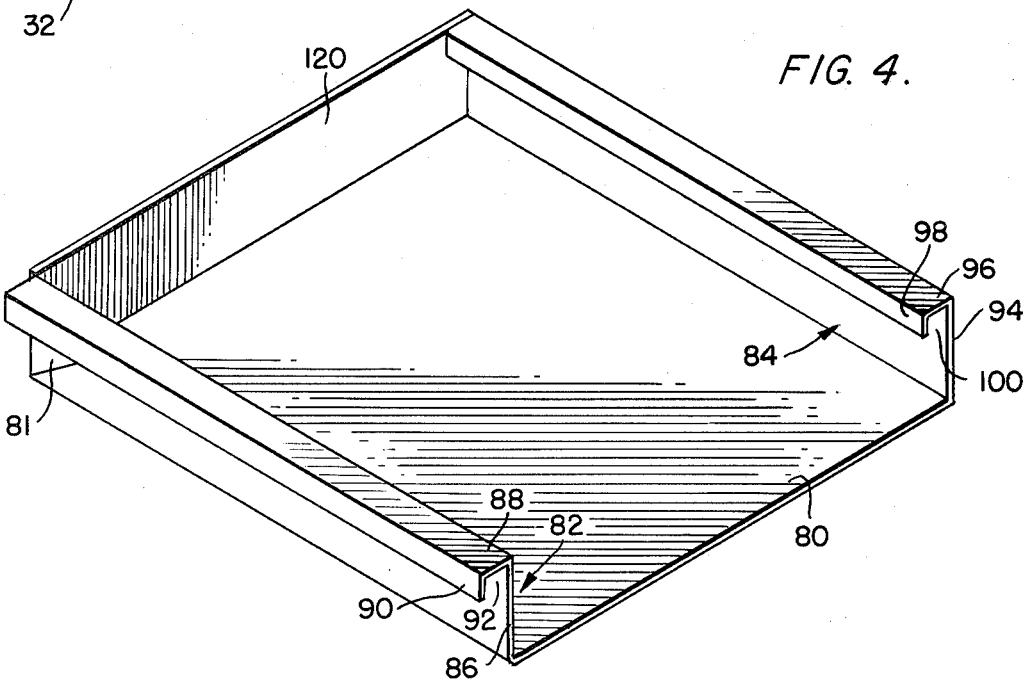
FIG. 4 is a perspective of one end of a building panel used in the roof structure embodying the teachings of the present invention.

The rear wall 120 on panels 28 and 32 is best shown in FIG. 4. The rims 88 and 96, and the seaming lips 90 and 98 are removed for a distance equaling the panel depth on sidewalls 82 and 84 respectively. The panel mid-portion 80 is folded up to form the rear wall 120. The flaps 81 are folded flush with the ribs 86 and 94 to form a watertight pan.

Thus, the lapped nature of the panels, along with the panel rear wall and the location of the fasteners outside of the area enclosed by the roof, prevents water from penetrating into the building.

Water penetrating roof panel 28 via fastener 64 will be directed into the trough-like area of panel 32 defined by the rear wall 120 and the side edges of the panel along with the mid-portion of the panel. This water will then drain out of the panel trough due to the slope of the building roof.

Figure 5:
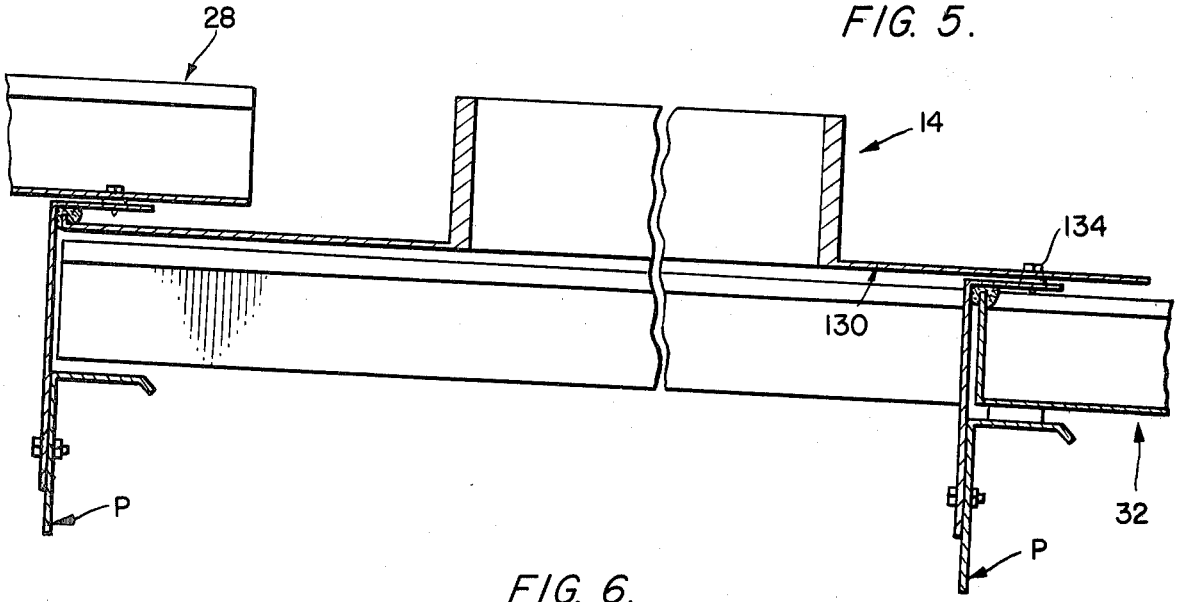
FIG. 5 is an elevation showing how a curb for a skylight or a roof jack is installed without penetration through the roof.
Figure 6:
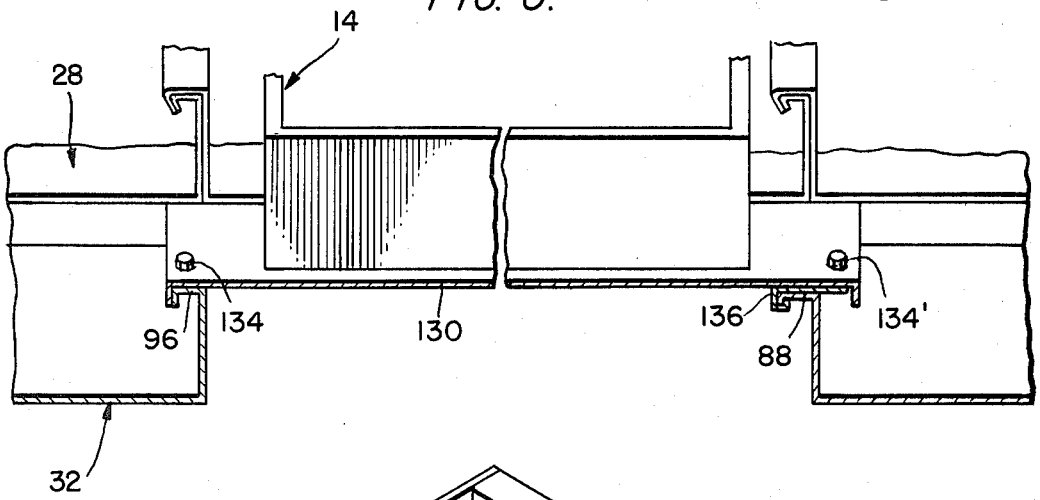
FIG. 6 is a view taken along line 6—6 of FIG. 1.

Curb 14 for a skylight or the like is best shown in FIGS. 5 and 6. The curb is integral with a base plate 130 which extends between adjacent purlins in FIG. 5 or spans a panel, as shown in FIGS. 1 and 6, whichever is suitable.

The base plate 130 is attached by fasteners, such as screws 134, or the like, to rim 96, or the seams 110 in the FIGS. 1 and 6 configurations. A plate 136 will be interposed between the base 130 and rim 88. Plate 136 interlocks with the seaming lip 90 of the panel sidewall 82, with fastener 134 attaching the plates 130 and 136 together. As above, there is no penetration into the interior of the building due to the fasteners used in conjunction with the curb 14.

The FIG. 5 embodiment shows a base plate spanning and being connected to two purlins. The base plate in FIG. 5 is attached to the brackets 50 and material 69 is interposed between the base plate and the panels. Again, no penetration into the building interior occurs as the brackets 50 and the material 69 are interposed between the fasteners and the building interior.

Other means and methods of mounting elements such as the curbs will occur to those skilled in the art based on this disclosure. Such other means and methods are also included in the scope of this disclosure.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A roof structure for metal buildings comprising:

building support elements;

a plurality of elongate roof panels overlying said building support elements, said panels each having a first end edge located nearer a building ridge than a panel second end edge, said panels having side edges which extend transversely of said building support elements and backstop means between the side edges at one end of each panel;

said plurality of panels including a plurality of first panels having said second end edges overlapping the first end edges of a plurality of second panels to define end laps;

a clip located adjacent to said end laps attaching each of said second panel first ends to one building support element;

an L-shaped bracket located adjacent to said end laps attaching said first panel second ends to said one building support element, said bracket including a first leg attached to said one building support element and a second leg extending longitudinally of said roof panels away from said one building support element toward said second panel second end edge;

attaching means attaching said bracket second leg to said first panel second end, said attaching means being located to be spaced from said second panel first end and said first panel resting on said bracket second leg; and closure means interposed between said attaching means and said bracket first leg so that said attaching means is located outside of the area enclosed by the roof structure.

2. The roof structure defined in claim 1 further including mounting means comprising a base plate attached to a panel and mounting a curb thereon.

3. The roof structure defined in claim 1 further including said backstop means being located on said panel first end edges and being integral therewith.

4. The roof structure defined in claim 3 wherein said backstop means includes a rear wall having an upper rim extending toward said panel second end edge.

5. The roof structure defined in claim 4 wherein said closure means further includes foam closure means interposed between said bracket second leg and said upper rim of said rear wall.

6. The roof structure defined in claim 5 wherein said bracket second leg is flexible so that thermally induced panel movement is accommodated by flexure of said bracket second leg.

7. A building roof system comprising:

building roof purlins for supporting roof panels thereon;

a plurality of roof panels traversely mounted on said purlins, each roof panel having a planar mid-portion with two upright side walls and the other end being open;

means for attaching the roof panels to the building roof purlins without penetration into the interior of the building including:

at least one panel having its open end overlapping at least a second panel traverse wall to provide a wide overall roof;

panel attaching means for holding the open overlapping end of said one panel to an associated roof purlin;

a panel clip for holding the traverse wall end of the other panel which is under the overlapping end of said one panel to said same roof purlin;

the other open end of said other panel held by panel attaching means in a manner similar to the overlapping end of said one panel; and both of said panel attaching means further provided with sealing closure means to prevent water penetration into the interior of the building.

8. The building roof system defined in claim 7, wherein said traverse wall of each roof panel is formed by removing the side walls of the roof panel for a distance equalling the panel side wall depth and then folding up the panel mid-portion to form said rear wall.

9. The building roof system defined in claim 8, wherein an upper rim of said rear wall engages the sealing closure means to effect said prevention of water penetration into the building interior.

10. The building roof system defined in claim 9, wherein said sealing closure means includes foam.

11. The building roof system defined in claim 7, wherein said panel attaching means includes a bracket having two leg portions, one leg portion being attached to an overlapped open end of a respective roof panel so as to have the roof panel penetration outside of the building interior, and the other leg portion being attached to an adjacent roof purlin.

12. The building roof system defined in claim 11, wherein said other leg portion of each bracket is flexible to accommodate thermal expansion and contraction of the roof panel to which it is attached.

13. The building roof system defined in claim 7, together with mounting means for attaching a skylight to the roof system.

14. The building roof system defined in claim 13, wherein said mounting means includes a base plate, and a curb for a skylight integral with said base plate.

15. A roof structure for a metal building of substantial width comprising:

building structure including side walls and roof support purlins extending parallel to said side walls for supporting a plurality of roof panels thereon;

a plurality of roof panels with side edges interlocked extending side-by-side longitudinally of the building along said side walls with one end of each of said roof panels supported along a side wall and the other respective end of each of said panels supported by an adjacent roof purlin;

another plurality of roof panels, each having one end thereof overlapping and supported by said same roof purlin and the other end of each panel mounted upon a roof purlin near the longitudinal center of the building;

each roof panel being of closed end configuration so that the overlap of the respective panels includes said closed end structure for assisting in prevention of water penetration into the interior of the building;

a panel clip holding the closed end structure of each respective plurality of roof panels to an associated roof purlin; and bracket means holding the other open end of each roof panel to an associated side wall and/or roof purlin.

16. The roof structure defined in claim 15, wherein said bracket means is semi-flexible to provide for thermal expansion and contraction of an associated roof panel after normal installation of same.

17. The roof structure defined in claim 15, together with foam sealing means provided at each overlapping junction of said plurality of roof panels.

18. The roof structure defined in claim 15, together with foam sealing means at the attachment of said plurality of roof panels along the building side walls.

19. The roof structure defined in claim 15, together with a ridge cap attached by bracket means so as to be fastened with penetration outside of the building interior to prevent water entrance thereto.

20. The roof structure defined in claim 19, further including foam sealing means at the ridge attaching bracket means for further preventing water entry into the building interior.

* * * * *